US006494504B1

(12) United States Patent
Fan

(10) Patent No.: US 6,494,504 B1
(45) Date of Patent: Dec. 17, 2002

(54) ADJUSTABLE LATCH ASSEMBLY

(76) Inventor: Fang-Chang Fan, No. 124, Pateh Rd., Jiayih City (TW)

( * ) Notice: Subject to any disclaimer, the term of this patent is extended or adjusted under 35 U.S.C. 154(b) by 0 days.

(21) Appl. No.: 09/978,930

(22) Filed: Oct. 16, 2001

(51) Int. Cl.[7] ..... E05C 1/00
(52) U.S. Cl. ..... 292/1.5; 292/337
(58) Field of Search ..... 292/1.5, 337, DIG. 60, 292/DIG. 44

(56) References Cited

U.S. PATENT DOCUMENTS

| | | | | | |
|---|---|---|---|---|---|
| 4,593,542 | A | * | 6/1986 | Rotondi | 70/134 |
| 4,639,025 | A | * | 1/1987 | Fann | 292/337 |
| 4,656,849 | A | * | 4/1987 | Rotondi | 70/134 |
| 4,768,817 | A | * | 9/1988 | Fann | 292/337 |
| 4,895,404 | A | * | 1/1990 | Toledano | 292/337 |
| 4,921,290 | A | * | 5/1990 | Dietrich | 292/337 |
| 5,169,184 | A | * | 12/1992 | Bishop | 292/1.5 |
| 6,419,288 | B1 | * | 7/2002 | Wheatland | 292/337 |

FOREIGN PATENT DOCUMENTS

| | | | | |
|---|---|---|---|---|
| EP | 0 307 088 | * | 3/1989 | E05B/65/10 |

* cited by examiner

*Primary Examiner*—Gary Estremsky
(74) *Attorney, Agent, or Firm*—William E. Pelton, Esq.

(57) ABSTRACT

A latch assembly has a casing, a housing, a latch bolt, a slide, a connecting member, a lever holder, a lever and an adjusting pin. A slot is longitudinally defined in the housing. Two detents are respectively defined in opposite ends of the slot. The slide is connected to the fixed member with the connecting member that engages one of the notches in the fixed member. A notch is defined in the bottom of the slide. A biasing member is arranged between the slide and the connecting member to provide a biasing force to the connecting member to engage the fixed member. The adjusting pin extends through one of the detents, aligns with the notch in the slide and abuts the bottom of the connecting member. With such an arrangement, only one hand is needed to adjust the latch assembly.

10 Claims, 8 Drawing Sheets

ADJUSTABLE LATCH ASSEMBLY

BACKGROUND OF THE INVENTION

1. Field of the Invention

The present invention relates to a latch assembly, and more particularly to an adjustable latch assembly that can be used for different types of locks and can be adjusted easily.

2. Description of Related Art

With reference to FIG. 7, a conventional latch assembly in accordance with the prior art comprises a casing (80), a latch bolt (81), a housing, a fixed plate (83), a connecting member (84), a lever holder (85), a lever (86) and an adjusting member (88). The latch bolt (81) is retractably received in the casing (80). The housing is securely attached to the casing and is composed of two half-housings (82, 822). The fixed plate (83) is mounted in the housing and is attached to the latch bolt (81). Two notches (832, 834) are defined in the top of the fixed plate (83). The connecting member (84) is slidably mounted on the fixed plate (83). A protrusion (842) is formed on the bottom of the connecting member (84) to selectively engage with one of the notches (832, 834) in the fixed plate (83). A first resilient member (844) is connected between the fixed plate (83) and the connecting member (84) to provide a force on the connecting member (84) to press the protrusion (842) to securely engage with the corresponding notch (832, 834).

The lever holder (85) is moveably received in the housing. The lever (86) is pivotally attached to the lever holder (85). The lever (85) is connected to the connecting member (84) with a link (87). A link pin (862) is slidably mounted through the lever (86) and engages with a recess (852) defined in the lever holder (85). A second resilient member (864) is attached to the lever holder (85) and abuts the bottom of the lever (86). The adjusting member (88) has a shaft (882) extending through the lever holder (85) below the connecting member (84). An oblique face (not numbered) is formed on the top of the adjusting member (88) to abut the bottom of the connecting member (84). A third resilient member (884) is mounted between the lever holder (85) and the adjusting member (88).

When the adjusting member (88) is pushed, the connecting member (84) will be lifted up by the oblique face on the adjusting member (88). The protrusion (842) of the connecting member (84) will disengage from the corresponding notch (832, 834) in the fixed member (83), and the connecting member (84) can slide relative to the fixed member (83). The lever (86) and the lever holder (85) will simultaneously move relative to the housing with the connecting member (84). The latch assembly is adjusted to fit with different size of door or lock.

However, the conventional latch assembly is very complex. To manufacture or assemble the conventional latch assembly is difficult. The cost for manufacturing the conventional latch assembly is expensive. In addition, the conventional latch assembly needs three resilient members (844, 864,884) to assist the actions of the connecting member (84), the lever (86) and the adjusting member (88). When one of the resilient members (844, 864, 884) loses its resilience, the latch assembly cannot operate properly and must be repaired or replaced. Furthermore, the retraction of the latch bolt (81) relative to the casing (80) is actuated by rotating the lever (86), which moves the link (87), the connecting member (84) and the fixed member (83). However, because the link (87) is pivotally connected between the connecting member (84) and the lever (86), there could be two dead points at the transmission mechanism arranged between the connecting member (84) and the lever (86).

With reference to FIG. 8, another conventional latch assembly in accordance with the prior art comprises a casing (90), a latch bolt (91), a housing (92), a fixed member (93), a connecting member (94), a slide (97), a lever holder (95), a lever (96) and an adjusting pin (98). The latch bolt (91) is retractably received in the casing (90). The housing (92) is securely attached to the casing (90). The fixed member (93) is received in the housing (92) and is connected to the latch bolt (91). The slide (97) is slidably mounted in the housing (92). A slot (972) is laterally defined in the slide (97). Two detents (974) are respectively defined in two ends of the slot (972). The connecting member (94) is pivotally attached to the fixed member (93). An engaging pin (942) is connected to the free end of the connecting member (94) to be selectively received in one of the detents (974) in the slot (972). A first resilient member (944) is arranged between the fixed member (93) and the connecting member (94) to provide a force on the connecting member (94) to press the engaging pin (942) to securely engage with the corresponding detent (974).

The lever holder (95) is moveably received in the housing (92). The lever (96) is pivotally attached to the lever holder (95). The uppermost end of the lever (96) engages with a recess (976) in the slide (97). A second resilient member (962) is attached to the lever holder (95) and abuts the bottom of the lever (96). The adjusting pin (98) extends through the lever holder (95) and is located below the connecting member (94).

When the adjusting pin (94) is lifted up, the connecting member (94) will be pivoted up to disengage the pin (942) from the corresponding detent (974) in the slide (97). The slide (97), the lever holder (95) and the lever (96) can be moved relative to the housing (92) to fit a different size door or lock.

Although the structure of the conventional latch assembly shown in FIG. 8 has been simplified, the user must use two hands to adjust the conventional latch assembly, one hand to lift up the adjusting pin (98) and the other hand to pull or push the lever holder (95). To adjust the conventional latch assembly is tedious.

To overcome the shortcomings, the present invention tends to provide an improved latch assembly to mitigate or obviate the aforementioned problems.

SUMMARY OF THE INVENTION

The main objective of the invention is to provide an improved latch assembly that can be adjusted easily. The latch assembly has a casing, a housing, a latch bolt, a slide, a connecting member, a lever holder, a lever and an adjusting pin. The housing is attached to the casing. A slot is laterally defined in the housing. Two detents are respectively defined at opposite ends of the slot. The latch bolt is retractably mounted in the casing. The fixed member is securely attached to the latch bolt. The fixed member has two notches defined in the top of the fixed member and a slot laterally defined in the fixed member. The slide is slidably mounted in the housing and is connected to the fixed member with the connecting member. The connecting member is slidably mounted on the fixed member and engages with one of the notches in the fixed member. A recess is defined in the bottom of the slide. A biasing member is arranged between the slide and the connecting member to provide a biasing force on the connecting member to engage with the fixed member. The lever holder is slidably mounted in the housing. The lever is pivotally attached to the lever holder and engages with the slide with the uppermost end of the lever. The adjusting pin extends through one of the detents in the housing, aligns with the notch in the bottom of the slide and abuts the bottom of the connecting member. When the adjusting pin is disengaged from the corresponding detents in the housing, the connecting member can be pushed to disengage from the corresponding one of the notches in the fixed member and the adjusting pin will engage with the notch in the slide. The slide with the lever holder and the lever can be pushed to move relative to the housing with the hand of the user, which lifts up the adjusting pin. To adjust the latch assembly is easier.

Other objects, advantages and novel features of the invention will become more apparent from the following detailed description when taken in conjunction with the accompanying drawings.

DETAILED DESCRIPTION OF PREFERRED EMBODIMENT

Figure 1:
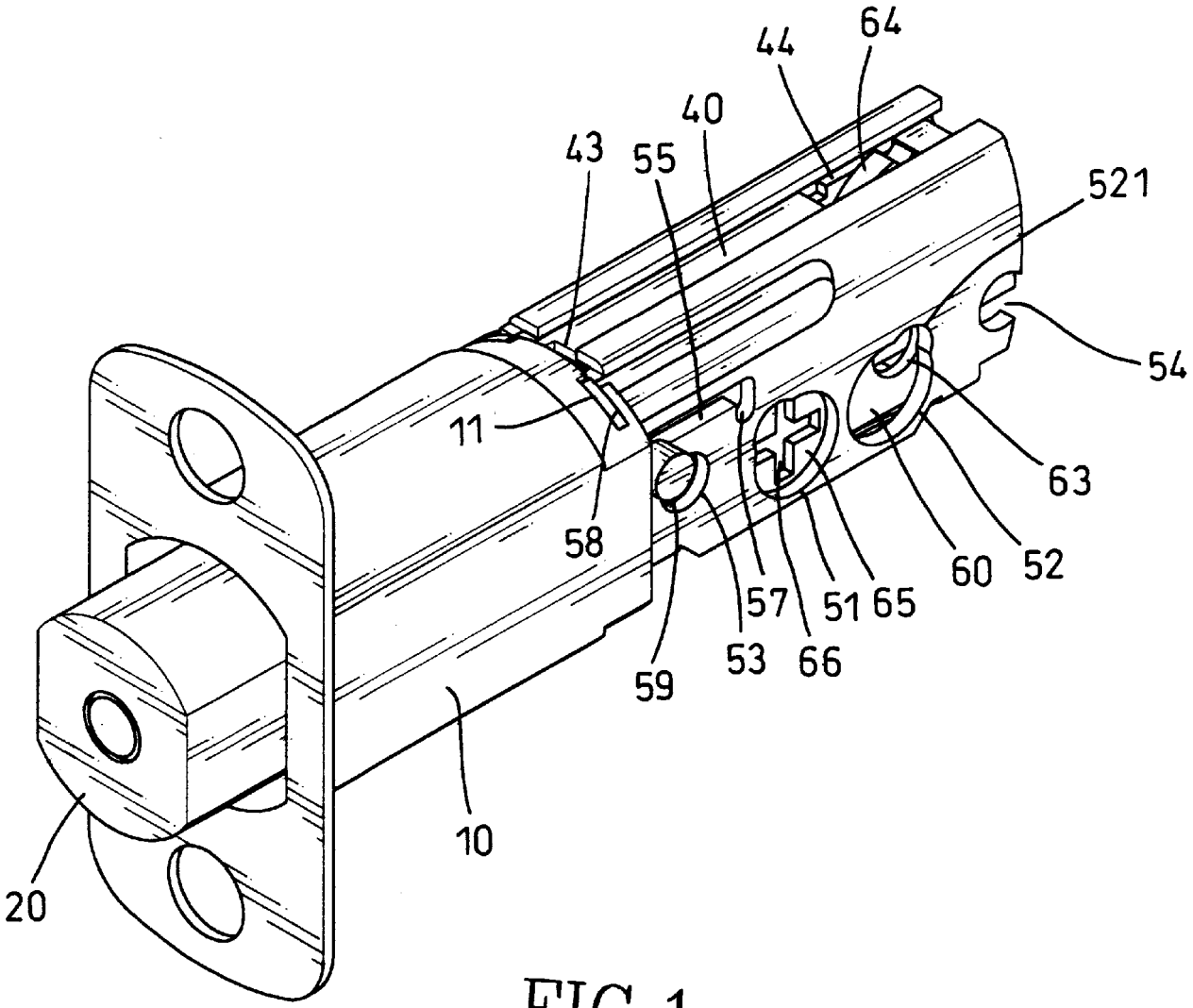
FIG. 1 is a perspective view of a latch assembly in accordance with the present invention.
Figure 2:
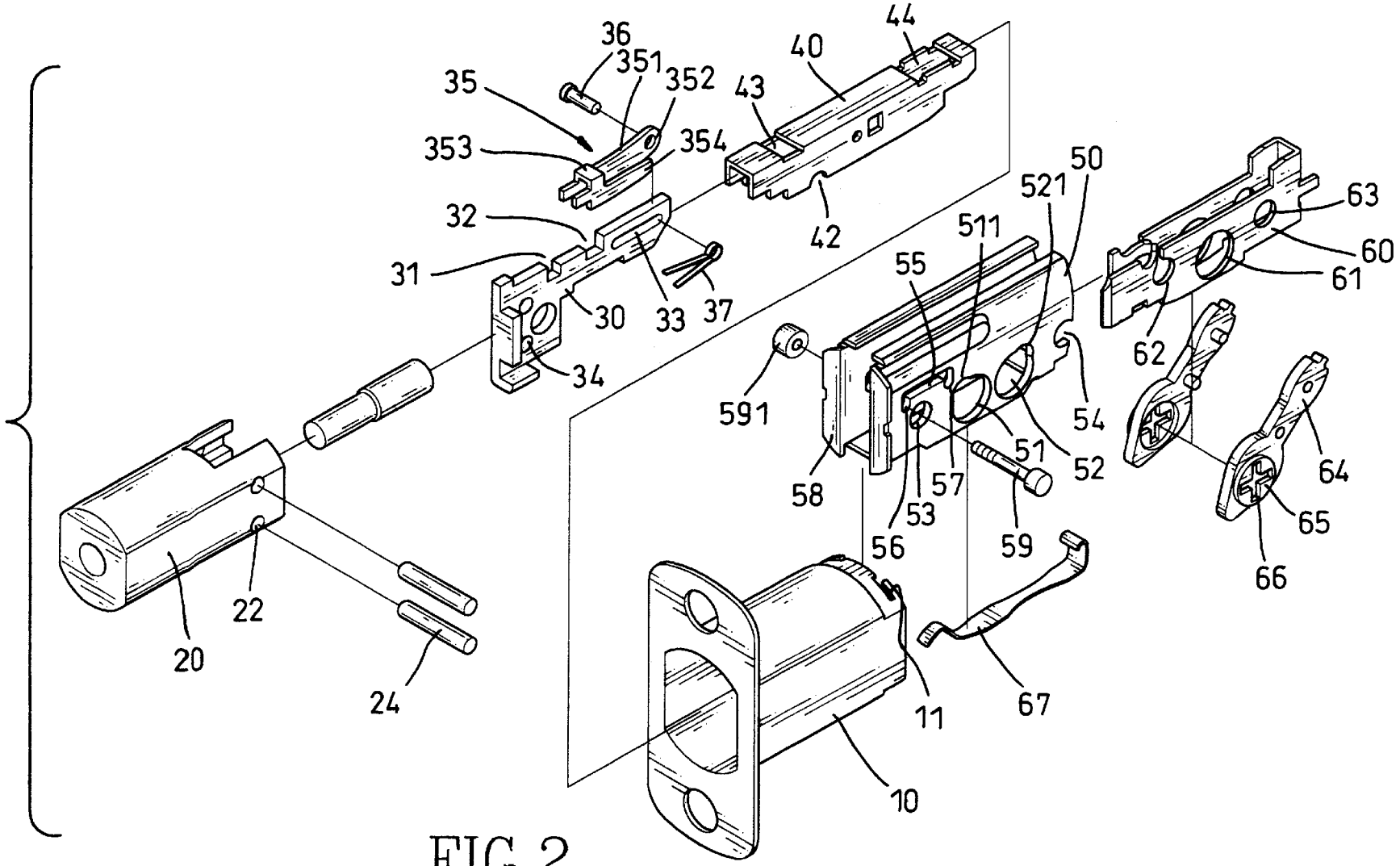
FIG. 2 is an exploded perspective view of the latch assembly in FIG. 1.
Figure 3:
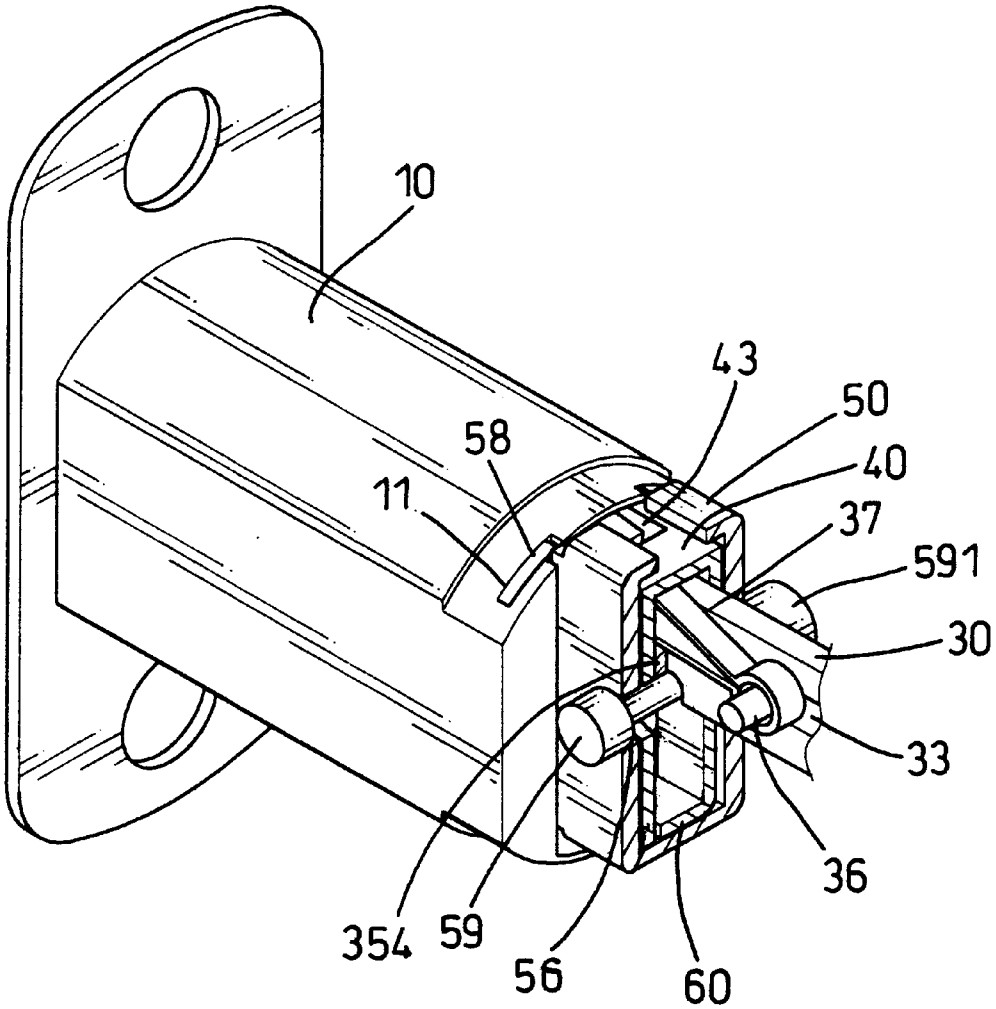
FIG. 3 is a partial perspective view in partial section of the latch assembly in FIG. 1.

With reference to FIGS. 1 to 3, a latch assembly in accordance with the present invention comprises a casing (10), a housing (50), a latch bolt (20), a fixed member (30), a slide (40), a connecting member (35), a lever holder (60), a lever (64) and an adjusting pin (59).

The housing (50) is attached to the casing (10). Two engaging slots (11) are defined in one end of the casing (10). Two ears (58) extend outward from the housing (50) and respectively engage with the engaging slots (11) in the casing (10) to attach the housing (50) to the casing (10).

A first through holes (51) and a second through hole (52) are defined in the housing (50) and each having a center aligning longitudinally on the housing (50) with that of the other. A pin notch (511, 521) is defined in an inner edge of each through hole (51, 52). Each pin notch (511, 521) has a center aligning with that of the pin notch (511, 521) in the other through hole (51, 52). A first pin hole (53) and a second pin hole (54) are defined in the housing (50) respectively at opposite sides of the through holes (51, 52). Each pin hole (53, 54) has a center aligning with the centers of pin notches (511, 521) in the housing (50). In addition, a slot (55) is longitudinally defined in the housing (50). Two detents (56, 57) are respectively defined in opposite ends of the slot (55).

The latch bolt (20) is retractably mounted in the casing (10). The fixed member (30) is securely attached to one end of the latch bolt (20). Multiple bores (22) are defined in the latch bolt (20). Multiple bores (34) are defined in the fixed member (30) and each bore (34) aligns with one of the bores (22) in the latch bolt (20). A pin (24) extends into each bore (22) in the latch bolt (20) and through each bore (34) in the fixed member (34) to securely attach the fixed member (30) to the latch bolt (20). A first notch (31) and a second notch (32) are defined in the top of the fixed member (30). A slot (33) is longitudinally defined in the fixed member (30) at the end away from the latch bolt (20).

The slide (40) is slidably mounted in the housing (50) and is connected to the fixed member (30) with the connecting member (35). A first opening (44) and a second opening (43) are defined in the top of the slide (40) near opposite ends of the slide (40). A notch (42) is defined in the bottom of the slide (40). The notch (42) aligns with the slot (55) in the housing (50).

The connecting member (35) is slidably and pivotally mounted on the fixed member (30) and is pivotally attached to the slide (40). The connecting member (35) is comprised of a long arm (351), a short arm (354) and a bridge (353). The long arm (341) is pivotally attached to the slide (40) with a pivot pin (36). A pivot hole (352) is defined near the free end of the long arm (351) to receive the pivot pin (36). The pivot pin (36) extends through the pivot hole (352) in the long arm (351) and the slot (33) in the fixed member (30) so as to slidably and pivotally attach the connecting member (35) to the fixed member (30). The short arm (354) has a length shorter than that of the long arm (351). The bridge (353) is formed between the long arm (351) and the short arm (354) to connect the long arm (351) to the short arm (354) and to engage one of the notches (31, 32) in the fixed member (30). The bridge (353) of the connecting member (35) faces the second opening (43) in the slide (40).

A biasing member (37) is pivotally attached to the pivot pin (36). The biasing member (37) has two ends respectively abutting the slide (40) and the short arm (354) of the connecting member (35). Consequently, the biasing member (37) can provide a biasing force on the connecting member (35) to securely hold the connecting member (35) in one of the notches (31, 32) in the fixed member (30).

The lever holder (60) is slidably mounted in the housing (50). A first pin hole (62) and a second pin hole (63) are defined in the lever holder (60), and one of the pin holes (62, 63) aligns with one of the pin holes (53, 54) in the housing (50). A pivot hole (61) is defined in the lever holder (60) between the pin holes (62, 63). The pivot hole (61) aligns with one of the through holes (51, 52) in the housing (50).

The lever (64) is pivotally mounted in the pivot hole (61) in the lever holder (60). The lever (64) is composed of two halves (not numbered) with each half having a cylindrical protrusion (65) with a keyhole (66). The lever (64) is pivotally attached to the lever holder (60) by means of the engagement between the pivot hole (61) and the protrusions (65) on the lever (64). The lever (64) has an uppermost end extending into the first opening (44) in the slide (40) and a lowermost end. A resilient plate (67) is attached to the lever holder (60) to press against the lowermost end of the lever (64).

The adjusting pin (59) extends through one of the detents (56, 57) in the housing (50), aligns with the notch (42) in the bottom of the slide (40) and abuts the bottom of the connecting member (35). A head (not numbered) with a diameter larger than that of the slot (55) in the housing (50)

is formed on one end of the adjusting pin (59). A fastener (591) with a lateral dimension larger than that of the slot (55) in the housing (50) is attached to the other end of the adjusting pin (59). This retains the adjusting pin (59) in the slot (55) in the housing (50).

Figure 4:
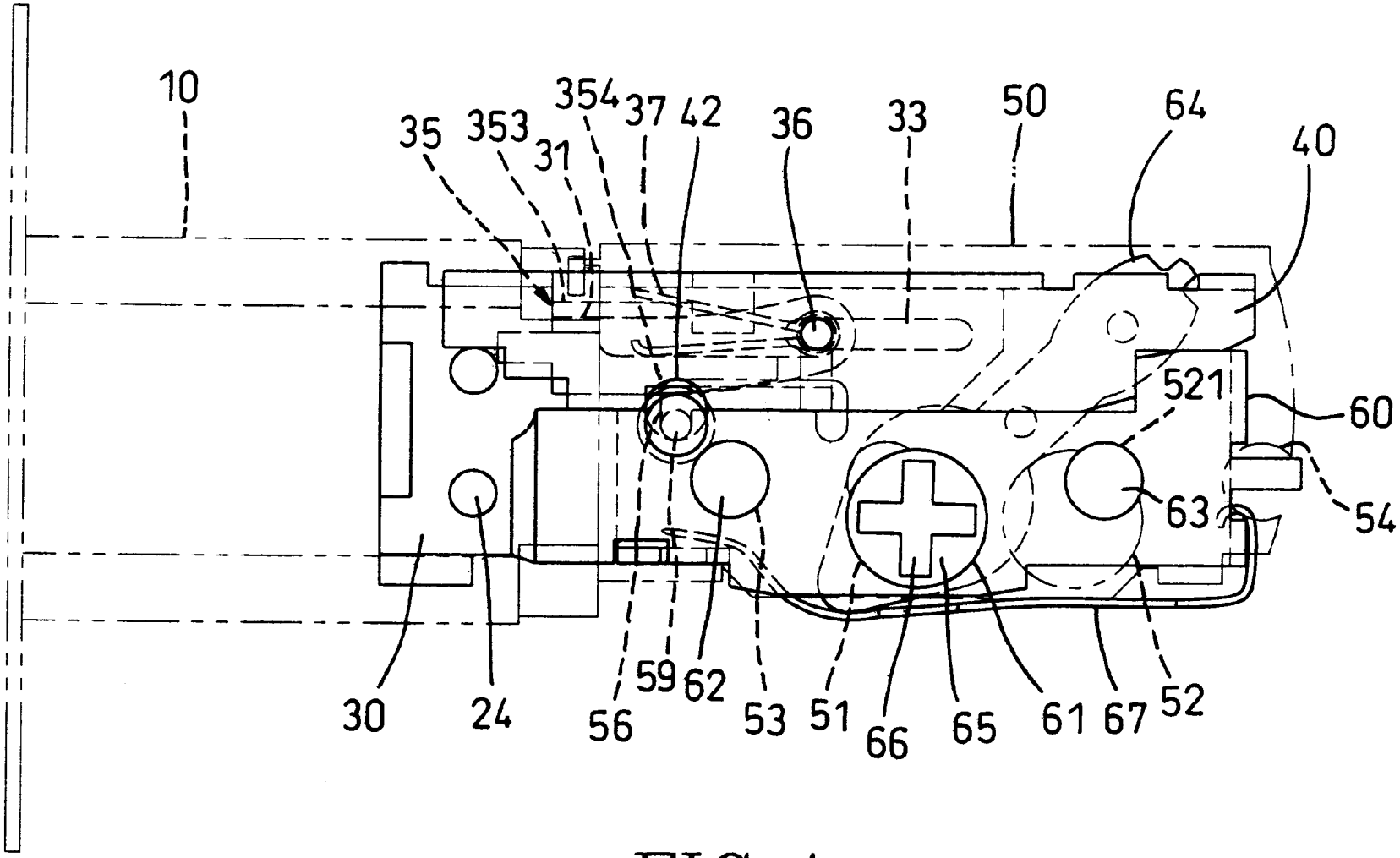
FIG. 4 is an operational side plan view of the latch assembly in FIG. 1 showing the latch assembly in a first position.

With reference to FIG. 2 and 4, when the bridge (353) on the connecting member (35) engages the first notch (31) in the fixed member (30), the keyhole (66) in the lever (64) engaging the pivot hole (61) will align with the first through hole (51) in the housing (50). The first pin hole (62) in the lever holder (60) aligns with the first pin hole (53) in the housing (50). Consequently, one pin (not shown) of a lock (not shown) can extend through the aligned first pin holes (53, 62) in the housing (50) and the lever holder (60), and the other pin of the lock can extend through the pin notch (511) in the first through hole (51) in the housing (50). The latch assembly is combined with a desired lock at a first position. When the lever (64) is rotated, the lever (64) will push the slide (40) and cause it to move relative to the housing (50). Because the connecting member (35) is pivotally attached to the slide (40) and engages with the first notch (31) in the fixed member (30), the fixed member (30) and the latch bolt (20) will move with the slide (40) through the transmission of the connecting member (35). The latch bolt (20) will be pushed out of the casing (10) to lock the door.

Figure 5:
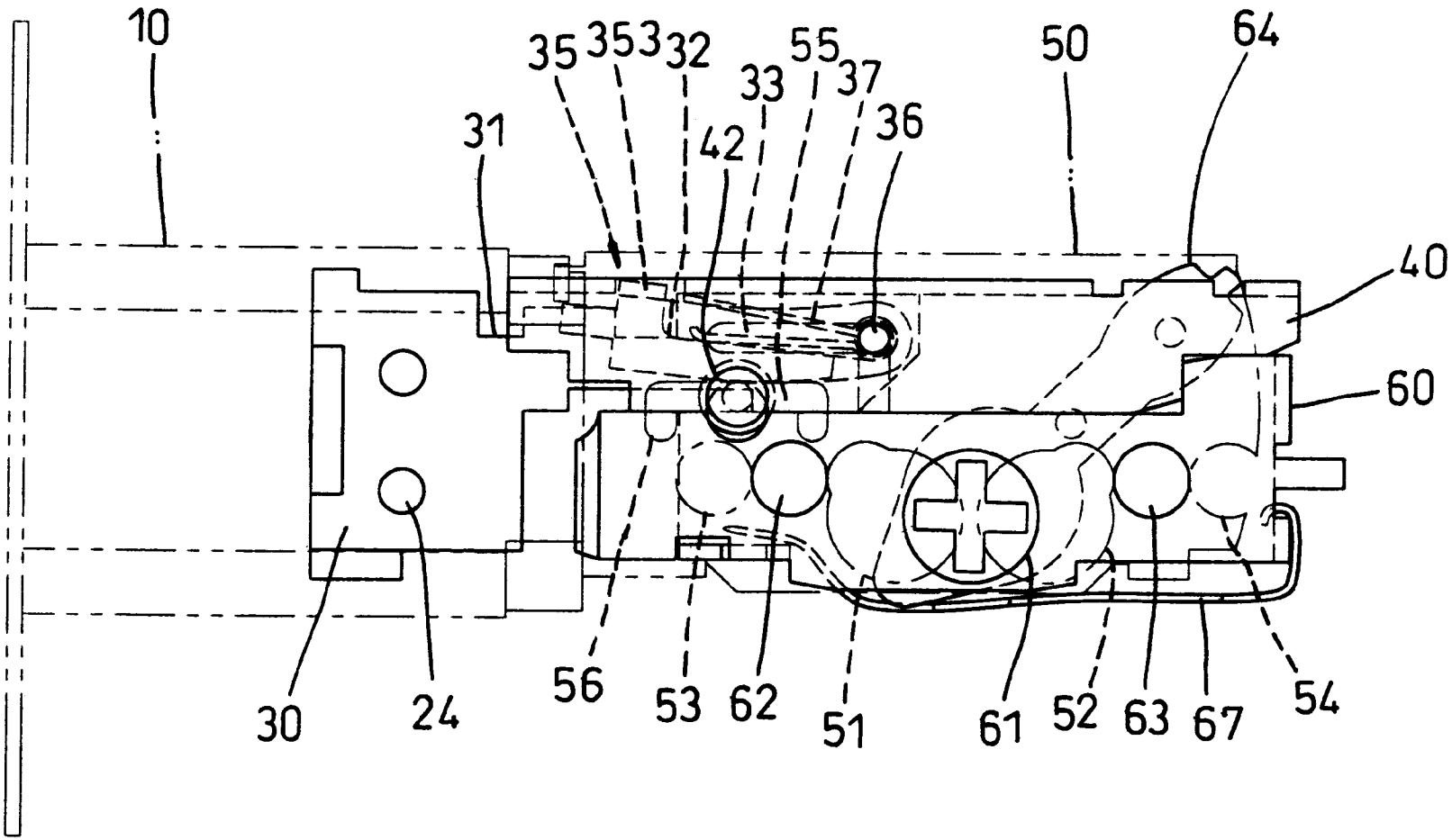
FIG. 5 is an operational side plan view of the latch assembly in FIG. 1 showing the latch assembly being adjusted.
Figure 6:
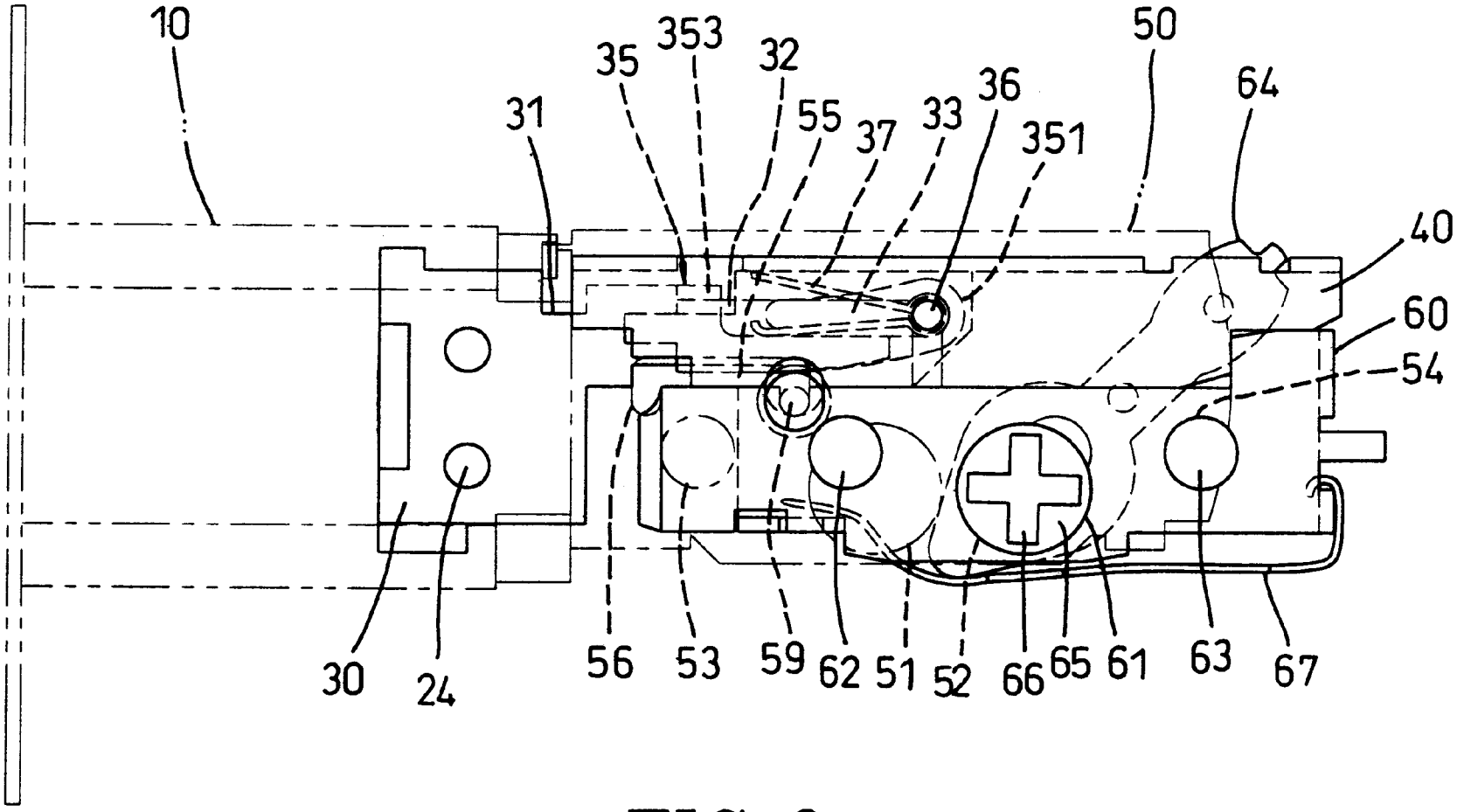
FIG. 6 is an operational side plan view of the latch assembly in FIG. 1 showing the latch assembly in a second position.
Figure 7:
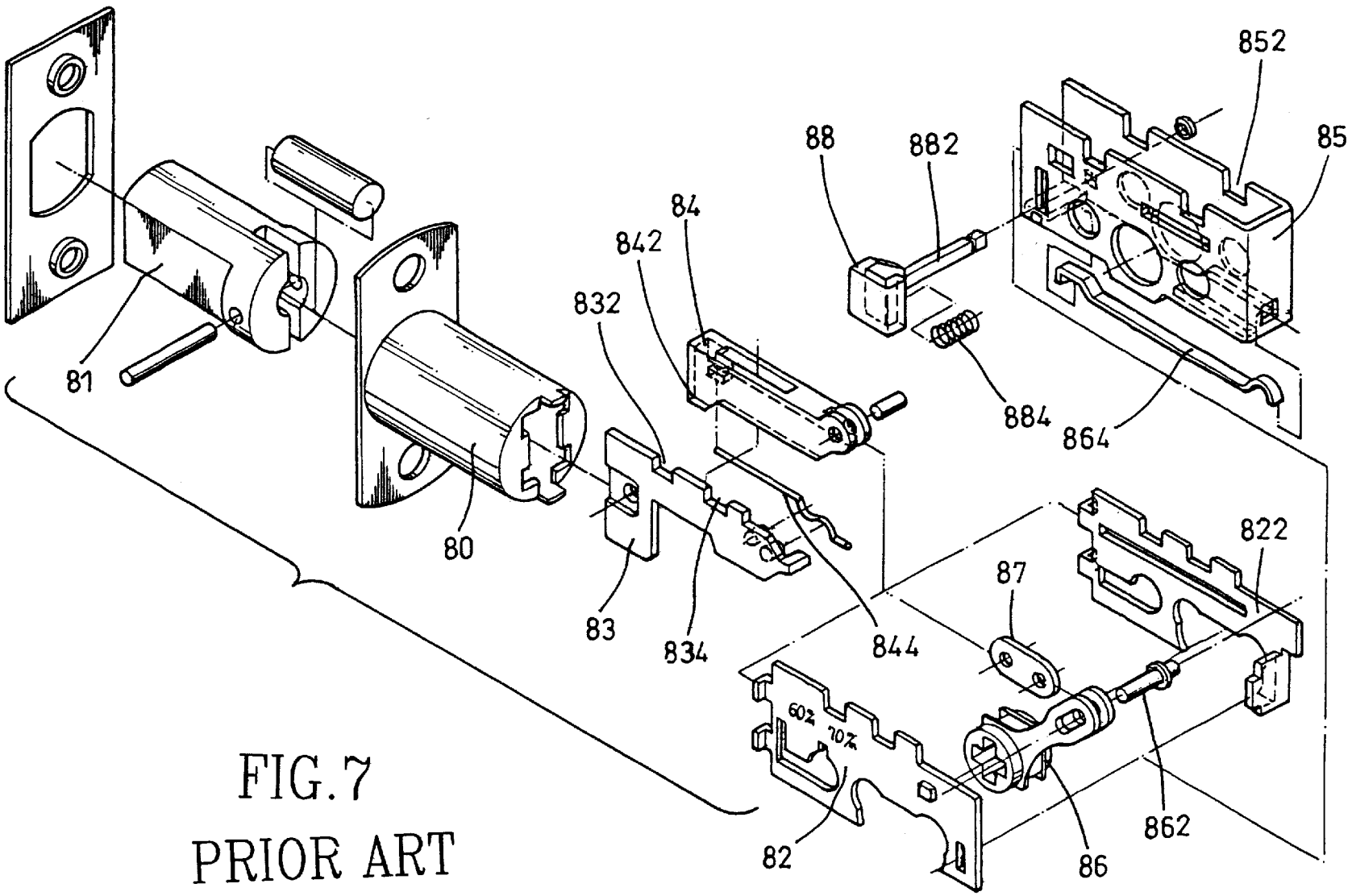
FIG. 7 PRIOR ART
FIG. 7 is an exploded perspective view of a conventional latch assembly in accordance with the prior art.
Figure 8:
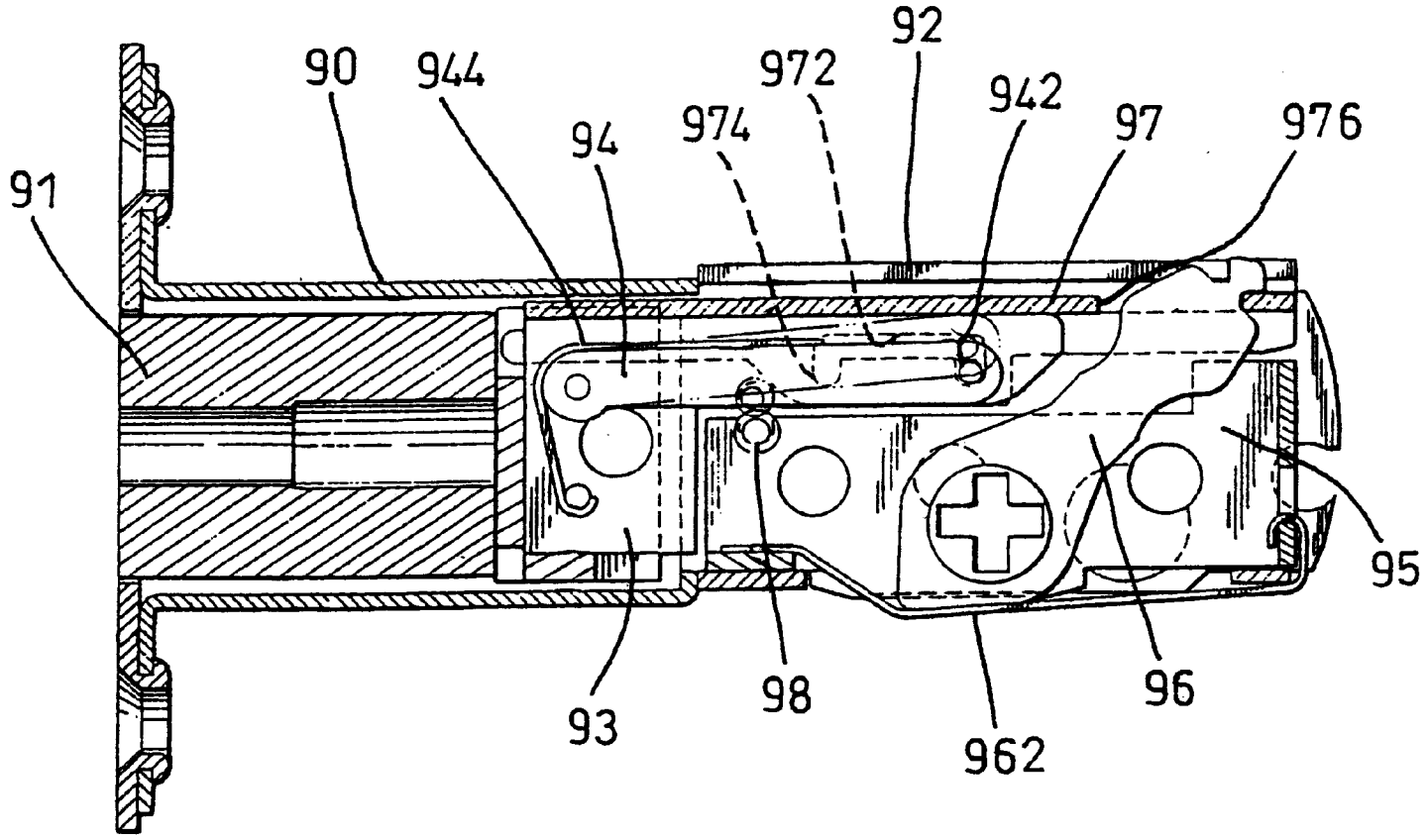
FIG.8 PRIOR ART
FIG. 8 is a side plan view in partial section of another conventional latch assembly in accordance with the prior art.

With reference to FIGS. 5 and 6, the latch assembly is adjusted by lifting and disengaging the adjusting pin (59) from the corresponding detent (56) in the housing (50). The adjusting pin (59) will enter into the slot (55) in the housing (50) and will engage with the notch (42) in the bottom of the slide (40). When the adjusting pin (59) is lifted up, the adjusting pin (59) will also push and pivot the connecting member (35) upward relative to the fixed member (30). Consequently, the bridge (353) on the connecting member (35) is pushed and disengaged from the corresponding notch (31) in the fixed member (30) and into the first opening (43) in the slide (40). The connecting member (35) can slide relative to the fixed member (30) along the slot (33). When the adjusting pin (59) is pushed along the slot (55) in the housing (50), the slide (40) will be pushed relative to the housing (50) due to the engagement between the adjusting pin (59) and the notch (42). The connecting member (35) will move with the slide (40), and the lever holder (60) with the lever (64) will move with the slide (40) due to the engagement between the first opening (44) in the slide (40) and the uppermost end of the lever (64). The lever holder (60) and the lever (64) can be moved relative to the housing (50).

When the connecting member (35) moves to a position where the bridge (353) aligns with the second notch (32) in the fixed member (30) and the adjusting pin (59) faces the other detent (57) in the housing (50), the bridge (353) will be automatically pushed downward to engage with the aligning notch (32) by the biasing member (37). The adjusting pin (59) will also be pushed to engage with the aligning detent (57) in the housing (50). The key hole (66) on the lever holder (64) will simultaneously align with the second through hole (52) in the housing (50), and the second pin hole (63) in the lever holder (60) will align with the second pin hole (54) in the housing (50). The two pins of the lock can respectively extend through the aligned second pin holes (54, 63) in the housing (50) and the lever holder (60) and the pin notch (521) in the second through hole (52) in the housing (50). The latch assembly can be combined with another lock at a second position to fit with a different size lock or door. The use of the latch assembly is more versatile.

Because the slide (40), the connecting member (35), the lever holder (60) and the lever (64) can be simultaneously pushed to move with the adjusting pin (59), only one hand is needed to adjust the latch assembly. Adjusting the latch assembly is easier. In addition, the number of elements of the latch assembly is reduced so the latch assembly is simplified. To manufacture or to assemble the latch assembly is easier. The cost manufacturing the latch assembly is reduced. Furthermore, only two resilient members (37, 67) are needed in the latch assembly. The failure rate of the latch assembly due to a loss of flexibility of the resilient member (37,67) is decreased. The useful life of the latch assembly is prolonged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A latch assembly comprising:

a casing;

a housing attached to the casing and having:

two through holes and each having a center aligning longitudinally with that of the other;

a pin notch defined in an inner surface of each through hole in the housing and having a center aligning with that of the pin notch in the other through hole; and two pin holes defined in the housing respectively at two sides of the through holes in the housing and each having a center aligning longitudinally with the centers of pin notches in the housing;

a latch bolt retractably mounted in the casing;

a fixed member securely attached to the latch bolt and having two notches defined in a top of the fixed member and a slot longitudinally defined in the fixed member;

a slide slidably received in the housing and connected to the fixed member with a connecting member that is slidably and pivotally mounted on the fixed member and engages with one of the notches in the fixed member, the slide having a first opening defined in a top of the slide and a notch defined in a bottom of the slide;

a biasing member arranged between the slide and the connecting member to provide a biasing force on the connecting member to cause the connecting member to securely engage with one of the notches in the fixed member;

a lever holder slidably mounted in the housing and having two pin holes defined in the lever holder, wherein one of the pin holes aligns with one of the pin holes in the housing; and a lever pivotally attached to the lever holder and having an uppermost end extending into the first opening in the slide, a lowermost end and a key hole defined in the lever and aligning with one of the through holes in the housing, wherein a slot is longitudinally defined in the housing and aligns with the notch in the bottom of the slide;

two detents are respectively defined in opposite ends of the slot; and an adjusting pin extends through one of the detents in the housing, aligns with the notch in the bottom of the slide and abuts a bottom of the connecting member, thereby when the adjusting pin is disengaged from the corresponding one of the detents in the housing and enters the slot in the housing, the connecting member is pushed to disengage from the corresponding one of the notches in the fixed member and the adjusting pin engages with the notch in the slide so as to push the slide with the connecting member, the lever holder and the lever to move relative to the housing along the slot in the housing.

2. The latch assembly as claimed in claim 1, wherein the connecting member comprises a long arm pivotally attached to the slide with a pivot pin;

a short arm with a length shorter than that of the long arm; and a bridge formed between the long arm and the short arm to connect the long arm with the short arm and to engage with one of the notches in the fixed member.

3. The latch assembly as claimed in claim 2, wherein the biasing member is pivotally attached to the pivot pin between the connecting member and the slide and having two ends respectively abutting the slide and the short arm of the connecting member.

4. The latch assembly as claimed in claim 2, wherein the slide has a second opening facing the bridge of the connecting member to receive the bridge as the connecting member is pushed upward by the adjusting pin.

5. The latch assembly as claimed in claim 1, wherein a pivot hole is defined in the lever holder and aligns with one of the through holes in the housing; and a cylindrical protrusion extends outward from the lever and is engaged with the pivot hole in the lever holder to pivotally attached the lever to the lever holder, wherein the key hole is defined in the protrusion.

6. The latch assembly as claimed in claim 5, wherein the lever is composed of two half levers each having a protrusion with a key hole.

7. The latch assembly as claimed in claim 1, wherein multiple bores are defined in the latch bolt;

multiple bores are defined in the fixed member and each aligns with one of the bores in the latch bolt; and a pin extends into each bore in the latch bolt and through each bore in the fixed member to securely attach the fixed member to the latch bolt with the pins.

8. The latch assembly as claimed in claim 1, wherein two engaging slots are defined in the casing; and two ears extend outward from the housing and respectively engage with the engaging slots in the casing to attach the housing to the casing by means of the engagement of each ear and the corresponding one of the slots.

9. The latch assembly as claimed in claim 1 further comprising a resilient plate secured to the lever holder to abut the lowermost end of the lever.

10. The latch assembly as claimed in claim 1, wherein a head with a diameter larger than that of the slot in the housing is formed on one end of the adjusting pin; and a fastener with a lateral dimension larger than that of the slot in the housing is attached to the other end of the adjusting pin to keep the adjusting pin from escaping from the slot in the housing.

* * * * *